United States Patent [19]

Ballerini

[11] 4,192,044

[45] Mar. 11, 1980

[54] CONNECTOR AND CAPTIVE BALL INCORPORATING SAME

[76] Inventor: Alberto Ballerini, 207 Lennox St., Richmond, Australia

[21] Appl. No.: 935,798

[22] Filed: Aug. 22, 1978

[30] Foreign Application Priority Data

Aug. 23, 1977 [AU] Australia ..... 1344/77
Jun. 15, 1978 [AU] Australia ..... 4741/78

[51] Int. Cl.[2] ..... A44B 17/00
[52] U.S. Cl. ..... 24/211 R; 273/58 C
[58] Field of Search ..... 24/211 R; 85/74, 5 E; 403/277; 273/58 C

[56] References Cited

U.S. PATENT DOCUMENTS

| | | | |
|---|---|---|---|
| 2,381,050 | 8/1945 | Hardinge | 85/74 |
| 2,500,073 | 3/1950 | Hayes | 273/58 C |
| 2,941,805 | 6/1960 | Chupa | 273/58 C |
| 3,214,107 | 10/1965 | Atkin | 279/2 |
| 4,044,725 | 8/1977 | Miller | 24/211 R |

FOREIGN PATENT DOCUMENTS

| | | | |
|---|---|---|---|
| 348974 | 6/1937 | Italy | 85/5 E |

*Primary Examiner*—Nile C. Byers, Jr.

*Attorney, Agent, or Firm*—Scully, Scott, Murphy & Presser

[57] ABSTRACT

The invention relates to a connector for detachable connection to an article to enable a cord, chain or the like to be attached to the article. There is disclosed a connector attached to a ball to provide a captive ball for playing games. The connector has a generally elongated body portion and is split longitudinally into two halves from one end to a position part the way along the connector. The one end is enlarged with respect to the body portion immediately adjacent thereto and a screw is adapted to cause expansion of the enlarged head in a direction transverse to the longitudinal axis of the connector when the head of the screw is pulled between the two halves by a cylindrical nut arranged on the screw in a cut-out in the body. The cut-out prevents longitudinal movement of the nut. Expansion of the end enables it to be retained in any suitable cavity accessible through a restricted neck portion. The other end of the connector has an enclosed loop for receiving a cord, chain or the like. The connector may be used to attach pendant jewelry to a neck chain or hang ornaments from a ceiling or other structure as well as for many other purposes. A further form of the connector having a cylindrical body for insertion into an article is also disclosed.

10 Claims, 5 Drawing Figures

CONNECTOR AND CAPTIVE BALL INCORPORATING SAME

This invention relates to an expandable connector adapted for detachable connection to any device having a cavity suitable for receiving said connector.

The connector of the invention, is particularly adapted for connection to a ball to enable attachment of a cord to the ball whereby the ball may be used as a captive ball for playing ball games. It should be appreciated however, that the invention is not limited to a ball connector as it may be used for many other purposes such as, for example, connecting pendant jewelry to a neck chain or hanging ornaments from a ceiling or other structure.

In the case of a captive ball numerous arrangements are known for connecting a cord to the ball but they generally suffer the disadvantage that either the cord is permanently affixed to the ball or, if detachable, the arrangement involves some permanent protrusion from the outer surface of the ball preventing its satisfactory use as a free ball. Furthermore, many of the known arrangements do not enable the ball to swivel on the cord and thus use in the captive condition causes the cord to become twisted.

Thus it is an object of this invention to provide an improved expandable connector suitable for use with inflatable and non-inflatable balls having a cavity suitable for receiving the connector which connector avoids or at least reduces the disadvantages of known arrangements and enables the ball to be used as a captive or non-captive ball for playing a ball game.

Figure 1:
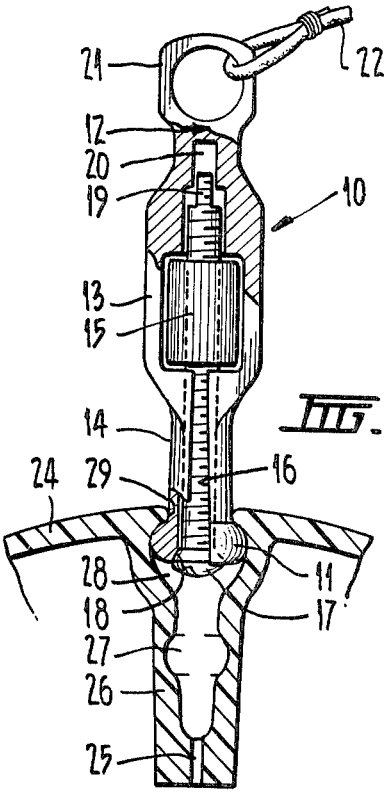
Figure 2:
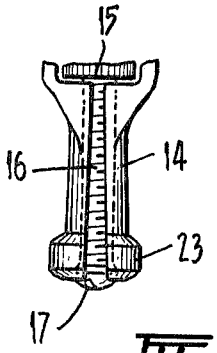
Figure 3:
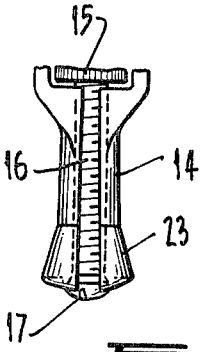
Figure 4:
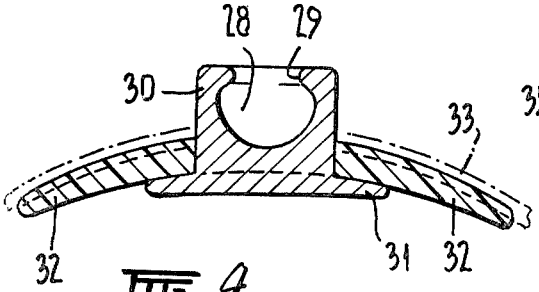
Figure 5:
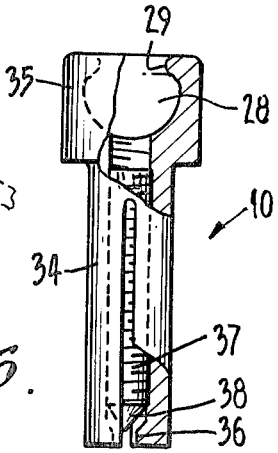

In order that the invention may be readily understood particular embodiments will now be described with reference to the accompanying drawings wherein:

FIG. 1 is a side elevation, partly in section, of a connector according to one embodiment of the invention shown attached to a ball, part of which is shown in FIG. 1, in section, FIG. 2 shows a modified end which may be provided on the connector of FIG. 1 for other applications, FIG. 3 shows a further modified end which may be provided on the connector of FIG. 1 for still other applications, FIG. 4 shows a sectional view of an insert adapted for use with a ball to provide a cavity for receiving the connector of FIG. 1 and FIG. 5 is a side elevation of a further embodiment of the connector of the invention.

Referring now to FIG. 1 the connector 10 has a generally elongated substantially cylindrical body having a part 11 of larger cross-section at one end of the connector. The connector 10 is split along the longitudinal axis into two halves joined together at a point 12 towards the other end of the connector. A further part 13 of larger cross-section is separated from the one end by a narrower cylindrical portion 14. The part 13 has flat opposed sides and a rectangular cut-out therein for accommodating a cylindrical nut 15. The flat sides enable the nut 15 to be readily rotated.

A screw member 16 is arranged in a longitudinal bore within the connector body. The bore extends from the one end to the aforementioned cut-out and slightly past the cut-out. The screw member 16 has a head 17 which is arranged between the two halves of the connector body at the part 11 of larger cross-section. The head 17 has a tapered surface 18 which co-operates with a corresponding surface in the one end of the connector body. The other end of the screw 16 extends into a short blind end of the bore on the opposite side of the cut-out. The end of the screw 16 has a flattened portion 19 which is received in a slot 20 in the blind end of the bore. The flattened portion 19 and the slot 20 co-operate to prevent rotation of the screw 16 when the nut 15, which is arranged thereon, is rotated.

The other end of the connector 10 has an enclosed loop 21 arranged thereon for retaining the end of a cord, or the like, 22 which is to be connected to an article, in this case a ball. The connector according to this embodiment is fabricated from metal but clearly it could be formed from other suitable materials and also it could be formed by a moulding process. As mentioned above FIGS. 2 and 3 show respective modified ends for the connector 10 wherein the part 11 of larger cross-section takes different forms. Whereas in the case of FIG. 1 the part 11 has curved shoulders the alternative of FIG. 2 shows the shoulders having a straight side portion 23. In FIG. 3 the part 11 has tapered side portions 23. Conceivably many other forms for the part 11 could be readily adopted by persons skilled in the art.

Referring again to FIG. 1 it can be seen that the connector 10 is used to connect the cord 22 to a ball for playing a ball game. The ball 24 of this embodiment is a moulded rubber ball which is inflated with air through inlet 25 prior to attachment of the connector 10. The inlet 25 is arranged in a radially inwardly extending boss 26 which is formed integral with the ball during moulding of the ball. The boss 26 includes a suitable cavity 27 for receiving and retaining a stopper (not shown) for blocking the inlet 25 so as to prevent deflation of the ball. A further cavity 28 is arranged in the boss 26 closely adjacent the outer surface of the ball. The cavity 28 has a generally spherical configuration with a narrower neck portion 29 at the outer surface of the ball restricting access to the cavity 28. The restriction caused by the neck portion 29 serves to retain the part 11 of the connector 10 in the cavity 28 when the connector is in use. As will be evident the connector 10 is attached to the ball by firstly rotating the nut 15 in a direction enabling the head 17 of the screw 16 to move out of a position between the two halves of the part 11. The two halves of the part 11 may then be moved together sufficiently to enable the part 11 to pass through the neck portion 29 and into the cavity 28. Once in the cavity 28 the nut 15 may be rotated in the opposite direction to pull the head 17 of the screw 16 back into a position where the surface 18 acts on the part 11 to force the two halves away from each other. The part 11 is expanded in a direction transverse to the longitudinal axis of the connector 10. Once expanded the part 11 is retained in the cavity 28 by means of the neck portion 29. Provided the part 11 is not expanded too far the connector 10 may rotate about its longitudinal axis whilst being attached to the ball 24. This ability to rotate prevents twisting of the cord 22.

It will be clear that the cavity 28 may be formed in many other ways. For example, the cavity 28 could be moulded in a separate boss away from the inlet 25 and cavity 27. In other words the ball may have two separate inwardly extending boss portions; one for the cavity 28 and another for the cavity 27. Also the cavity 27 could incorporate a valve member enabling the ball to be inflated from time to time should pressure reduce within the ball. In the case of a solid ball a cavity 28 may be provided in the outer surface by using a suitable boring tool. Similarly the connector 10 may take various other forms to that shown in FIG. 1. For example the screw member 16 may be arranged transverse to the longitudinal axis of the connector 10 so as to force the two halves away from each other as required. In either case it is desirable that the screw member be operable from a position well away from the part 11 thus enabling operation of the arrangement without interfering with the article to which the connector is attached. The arrangement shown in FIG. 1 is of course the most preferable arrangement as the force separating the two halves is applied at the end part 11 where it is necessary. In the case of a transverse screw member the force is applied somewhere away from the part 11 and thus resilience in the material from which the connector is formed may enable the two halves to move together slightly in use. This could cause the connector to become detached from the article.

FIG. 4 shows an insert arrangement for providing a cavity 28 at the outer surface of an inflatable leather ball. The insert consists of a cylindrical boss 30 having a flange 31 at one end and the cavity 28 accessible from the other end. Again the cavity 28 is accessible through a narrower neck portion 29. A leather or like washer 32 fits over the cylindrical part of the boss 30 as shown. In use the insert is arranged inside the ball in a manner such that only the end of the boss having the cavity 28 therein projects through the casing 33 of the ball. Preferably the insert is arranged at a seam of the ball where the stitching may be omitted to enable adjacent parts of the casing 33 to be separated slightly to form an aperture through which the boss may project. The washer 32 has grooves therein for receiving any inwardly projecting material which occurs along the seam of the ball.

FIG. 5 shows an alternative form of the connector 10 which may be used as a separate and distinct connector or, as in the case of the FIG. 5 arrangement, in combination with the connector shown in FIG. 1. The connector 10 of FIG. 5 consists essentially of a cylindrical portion 34 for attachment to an article and a head portion 35 for receiving some attachment means, in this case, a connector as shown in FIG. 1. The cylindrical portion 34 is split longitudinally into two halves in a similar manner to the connector of FIG. 1. A bore is arranged to extend longitudinally through the connector 10 and has a portion 36 of reduced cross-section at one end of the connector. The bore is threaded and a screw 37 is arranged therein. The screw 37 is tapered to a point 38 at one end and the tapered surface is adapted to co-operate with a corresponding surface in the bore at the part 36 of reduced cross-section. The other end of the screw 37 is adapted to receive a suitable tool which may be inserted in the bore at the other end of the connector. In this particular embodiment the screw has a hexagonal aperture in the end for receiving a correspondingly shaped tool. As will be appreciated, rotation of the screw 37 causes the tapered point 38 to act on the portion of reduced cross-section 36 causing the two halves of the connector to separate at the end. Thus when the body portion 34 is arranged within a cylindrical bore of slightly greater cross-section the two halves may be separated sufficiently by rotation of the screw 37 to cause the end of the connector to be retained therein. Since the screw 37 is not tending to pull the connector out of an article to which it is being attached a considerable force may be achieved to hold the connector firmly in the article. This is contrary to known connectors which use the screw to pull a wedge member outwardly to expand the connector and the same screw to attach some external device to the article. In the present case some other means is provided for attaching a device to the connector. In this embodiment the connector has a head portion 35 with a cavity 28 as previously described. Thus the connector of FIG. 5 may be attached to some article to provide a suitable cavity for receiving a connector as shown in FIG. 1. Alternatively the connector of FIG. 5 may be provided without the head portion 35 in which case it may be inserted in an article to receive a further screw for holding some other device to the article. Many other arrangements for the head portion 35 may be readily provided.

Whilst the connector of this invention has been described essentially in its application to a captive ball arrangement it is envisaged that the connector will have many other applications. For example, a minature form of the connector could be provided to support pendant jewelry on a suitable neck chain. In another case the connector could be used to suspend ornaments and the like from a ceiling or other structure. In the case of a captive ball the connector may be used to connect a cord to the ball merely for carrying the ball. This would avoid the need for a net or large bag which is often necessary to transport a large ball. It should be appreciated that when the connector 10 is detached from the ball the ball may be used as a normal free ball as it does not have any protrusions or other undesirable features resulting from its adaption to receive the connector. Clearly there are unlimited applications for the connector as will be apparent to persons skilled in the art.

Whilst the cavity 28 has been shown in FIGS. 4 and 5 to have a generally spherical configuration in practice it would have parallel sides and thus become more cylindrical for ease of manufacture.

In the case of a rubber or synthetic ball it has been found that a cavity 28 may be readily formed in an existing ball having a boss 26 for retaining a stopper merely by forcing the stopper inwardly into a more compressed state and using the head of a nail which is made very hot as a means to melt the ball to form the cavity 28 at the outer surface thereof.

I claim:

1. A connector having a generally elongated body portion which is split in a longitudinal direction from one end to a position part the way along its length so as to form two side members which are joined at said position and which may be resiliently separated at said one end, said connector having a part at or adjacent said one end which is of greater cross-sectional dimension than the cross-sectional dimension of the connector at least adjacent said part and in a direction towards said position, manually operable screw means on said connector and operable to force said two members away from each other causing said part to expand in a direction transverse to said longitudinal direction, said connector being held, by said part, in detachable connection with an article having a cavity therein accessible via a restricted neck portion in a manner wherein said connector is rotatable about the longitudinal axis thereof and at least partly pivotal in any direction relative to said article, and said connector having means adjacent the other end thereof for retaining a cord, chain, or the like.

2. A connector as defined in claim 1 wherein said screw means comprises a screw non-rotatably arranged along the longitudinal axis of said connector between said members and having a head arranged at said one end and adapted to move between the free ends of said members when said screw is caused to move longitudinally, and a nut rotatably arranged on said screw, means on said body portion to hold said nut against longitudinal movement such that rotation thereof causes said screw to move longitudinally.

3. A connector as defined in claim 1 wherein said article is a ball which is adapted for attachment to said connector for providing a captive ball for playing a ball game, said cavity being an inwardly extending cavity at the outer surface of said ball and said neck portion being of reduced cross-section compared with said cavity and being at or adjacent said outer surface.

4. A ball and connector arrangement as defined in claim 3 wherein said screw means comprises a screw non-rotatably arranged along the longitudinal axis of said connector between said members and having a head arranged at said one end and adapted to move between the free ends of said members when said screw is caused to move longitudinally and a nut rotatably arranged on said screw, means on said body portion to hold said nut against longitudinal movement such that rotation thereof causes said screw to move longitudinally.

5. A ball and connector as defined in claim 4 wherein said head is tapered to facilitate movement between said free ends of said members, said ball is an inflatable ball and said cavity provides access to a passageway for inflating said ball, said passageway having a valve or stopper therein to prevent air in said ball from escaping.

6. A ball and connector arrangement as defined in claim 5 wherein said cavity and said passageway are formed in an inwardly extending protrusion within said ball, said protrusion being moulded inegral with said ball.

7. A connector as defined in claim 2 wherein said nut is a cylindrical nut and said means to hold said nut against longitudinal movement comprises a cut-out in said body portion, which cut-out serves to prevent any substantial movement of said nut in a longitudinal direction, and said means adjacent the other end of said body portion comprises an enclosed loop formed integral with said body portion.

8. A ball and connector as defined in claim 4 wherein said ball is an inflatable ball and said cavity is provided in an insert adapted to extend through the casing of the ball from inside to outside, said insert being generally cylindrical and having a flange on the inside end to hold said insert within the ball, said cavity being arranged in the outermost end of the insert.

9. A ball and connector as defined in claim 8 wherein said ball is a leather ball, said insert being inserted through said casing at a seam of the ball, and a large washer being provided between said flange and the inside of said casing.

10. A connector as defined in claim 2 wherein said article is ornamental jewelry and said means adjacent the other end thereof is an enclosed loop for receiving a neck chain or the like for supporting said jewelry.

* * * * *